United States Patent [19]

Tsuge et al.

[11] Patent Number: 4,552,469

[45] Date of Patent: Nov. 12, 1985

[54] INK DOT PRINTER

[75] Inventors: Takeyoshi Tsuge; Yoshihiro Torisawa; Ayumu Makino, all of Mishima; Tsutomu Kimura, deceased, late of Mishima, all of Japan, by Shizuko Kimura, legal representative

[73] Assignee: Tokyo Electric Co., Ltd., Tokyo, Japan

[21] Appl. No.: 617,368

[22] Filed: Jun. 5, 1984

[30] Foreign Application Priority Data

Jun. 10, 1983 [JP] Japan ..... 58-103958
Jun. 22, 1983 [JP] Japan ..... 58-112237
Jun. 22, 1983 [JP] Japan ..... 58-112241

[51] Int. Cl.[4] ..... B41J 3/12; B41J 27/18

[52] U.S. Cl. ..... 400/119; 101/93.05; 346/140 R; 400/124; 400/470

[58] Field of Search ..... 400/124, 121, 118, 119, 400/470; 101/1, DIG. 5, 93.04, 93.05; 346/140

[56] References Cited

U.S. PATENT DOCUMENTS 3,509,816 5/1970 Spaulding ..... 101/1
3,916,419 10/1975 Fan et al. ..... 346/1.1

FOREIGN PATENT DOCUMENTS 95682 8/1981 Japan ..... 400/124

OTHER PUBLICATIONS

*IBM Tech. Disc. Bulletin,* by K. S. Pennington, vol. 16, No. 10, Mar. 1974, pp. 3414–3415, 400–126.

*Primary Examiner*—Paul T. Sewell
*Attorney, Agent, or Firm*—Frishauf, Holtz, Goodman & Woodward

[57] ABSTRACT

An ink dot printer comprises: an ink tank storing magnetic ink; a pair of magnetic pole plates arranged opposite to each other to form a slit whose one end is immersed in the magnetic ink in the ink tank; an electromagnet magnetizing the paired magnetic pole plates to introduce the magnetic ink in the ink tank into the slit to form a magnetic ink film therein; a plurality of needles arranged adjacent to one another along the longitudinal direction of the slit where each is freely movable in its longitudinal direction between a first position where its one end portion is immersed in the magnetic ink film in the slit and a second position where its one end portion is projected from the magnetic ink film in the slit; electromagnets for selectively driving the needles to move from the first position to the second position; and stoppers which collide with the needles in the course of their moving from the first position to stop the needles at the second position; wherein the driving force produced in the electromagnets is so set that the magnetic ink is flied from the end faces of the one end portions of the needles onto a recording paper thanks to an inertia of the magnetic ink on the end faces of the one end portions of the needles which is caused by the collision of the needles with the stoppers.

17 Claims, 12 Drawing Figures

INK DOT PRINTER

BACKGROUND OF THE INVENTION

The present invention relates to an ink dot printer comprising a means for storing magnetic ink, a pair of magnetic pole plates arranged opposite to each other to form a slit whose one end is immersed in magnetic ink supplied from the magnetic ink storing means, a magnetism generating means for magnetizing the pair of magnetic pole plates to introduce magnetic ink supplied from the magnetic ink storing means into the slit and form a magnetic ink film in the slit, a plurality of needles arranged adjacent to one another along the longitudinal direction of the slit and each freely movable in the longitudinal direction of the needle between a first position where its one end portions are immersed in the magnetic ink film in the slit formed by the paired magnetic pole plates and a second position where its one end portions are projected from the magnetic ink film in the slit, and a driving means for selectivly driving the needles to move between the first and second positions, wherein the one or more needles selected force magnetic ink, which has been stuck on their end faces of the one end portions at the first position, onto a recording paper at the second position to form dots of magnetic ink on the recording paper so as to print symbols such as characters or numerals on the recording paper by the grouping of these dots.

The wire dot printer or thermal printer which is usually used these days is the ink dot printer. The wire dot printer selectively drives needles whose tips directly strike a pressure-sensitive manifold paper on a platen or whose tips indirectly strike a recoding paper on the platen through an ink ribbon interposed between the tips of the needles and the recording paper. In this fashion, dots are formed on the pressure-sensitive manifold paper or recording paper to print symbols such as characters or numerals by the grouping of these dots. In this conventional wire dot printer, however, a large amount of noise is caused when the symbols are printed onto the pressure-sensitive manifold paper or recording paper. In addition, no other paper except for the pressure-sensitive manifold paper can be used. Further, the expensive ink ribbon of the latter method must be changed frequently. The expensive ink ribbon also must be used in the thermal printer.

In order to eliminate the drawbacks of the conventioal wire dot printer or thermal printer, there have been proposed various kinds of ink dot printers wherein magnetic ink is stuck on the end faces of the front end portions of the needles and wherein these needles are driven selectively to transfer the magnetic ink onto the recording paper to form dots thereon. In the case of these ink dot printers, however, the end faces of the front end portions of the needles must be appropriately positioned relative to the recording paper on the platen when the magnetic ink is transferred from the end faces onto the recording paper on the platen. It not, the end faces of the front end portions of the needles strike the recording paper on the platen too strongly, as in the case of the conventional wire dot printer, thus generating too much noise. In addition, the dots of the magnetic ink transferred onto the recording paper are scattered by the excessive force of the end faces striking the paper, thus making the contour of the dots blurred. Adjusting the distance of the needles from the platen troublesome task, and must be frequently repeated since the needles are repeatedly driven.

SUMMARY OF THE INVENTION

The present invention is therefore intended to eliminate the above-mentioned drawbacks, and the object of the present invention is to provide an ink dot printer capable of forming dots without generating an excessive amount of noise, and being easily and less frequently maintained.

The object of the present invention can be achieved by an ink dot printer comprising: a means for storing magnetic ink; a pair of magnetic pole plates arranged opposite to each other to form a slit whose one end is immersed in the magnetic ink supplied from the magnetic ink storing means; a magnetism generating means for magnetizing the paired magnetic pole plates to introduce the magnetic ink supplied from the magnetic ink storing means into the slit to form a magnetic ink film therein; a plurality of needles arranged adjacent to one another along the longitudinal direction of the slit where each is freely movable in its longitudinal direction between a first position where its one end portion is immersed in the magnetic ink film in the slit formed by the paired magnetic pole plates and a second position where its one end portion is projected from the magnetic ink film in the slit; a driving means for selectively driving the needles to move from the first position to the second position; a space forming means for separating the end faces of the one end portions of the needles, which have been located at the second position, from a recording paper on a platen by a distance greater than the thickness of the magnetic ink on each of the end faces; and a magnetic ink flying means for flying the magnetic ink from the end faces of the one end portions of the needles, which have been located at the second position, onto the recording paper on the platen to force the magnetic ink on the recording paper on the platen to form dots of magnetic ink thereon; wherein symbols such as characters or numerals can be printed on the recording paper by the groupings of dots of the magnetic ink.

According to the present invention, the magnetic ink flying means may have a magnet located on the side of the platen which is opposite to the end faces of the one end portions of the needles. It is preferable in this case that the magnet be a magnetized platen. The magnetized platen may be made of a permanent magnet, an electromagnet, a synthetic resin or rubber containing magnetic material, or any other metals magnetized by a magnet. The arrangement of this magnet makes the magnetic ink flying means simpler in construction and more reliable in performance.

According to the present invention, the space forming means may include stoppers which collide with the needles in the course of their moving from the first position to stop them at the second position.

It is preferable in this case that armatures which follow the needles moving between the first and second positions are attached to the other end portions of the needles, the driving means includes electromagnets to selectively draw the armatures to selectively move the needles from the first to the second position, and the armatures collide with the stoppers to stop the needles at the second position in the course of their moving from the first position. When constructed as described above, the driving means can be made simpler in construction and more reliable in performance. It is also preferable that the stoppers be the cores of the electromagnets. If so, the driving means can be combined with the stoppers to form a unit which is simpler in construction.

It may be also arranged that the space forming means is constructed by setting the mass of each of the needles to have a predetermined value which corresponds to the driving force of the driving means and which enables the needle to be stopped at the second position without applying any external force to it in the course of its moving from the first position. When constructed so, noise generated during the operation of the ink dot printer can be reduced as compared with the case where the needles are stopped at the second position by the action of the stoppers.

When the mass of each of the needles is so set as described above, it is preferable that armatures movable in the movement direction of the needles are disposed depending on the positions of the other ends of the respective needles, and the driving means includes electromagnets to selectively draw the armatures and to selectively move the needles from the first position to the second position, the magnitude of the driving force of the driving means being adjusted by the magnitude of the magnetic force generated by the electromagnets.

When constructed as described above, the construction of the driving means can be simplified and work for adjusting the magnitude of the driving force produced by the driving means to a predetermined value which corresponds to the predetermined value of the mass of each of the needles becomes easy.

According to the present invention, the space forming means may include stoppers which collide with the needles in the course of their moving from the first position to stop the needles at the second position and the magnetic ink flying means may be adapted to set the driving force of the driving means in such a way that the magnetic ink flies from the end faces of the one end portions of the needles onto the recording paper thanks to an inertia of the magnetic ink on the end faces of the one end portions of the needles which is caused by the collision of the needles with the stoppers. Similarly in the above-mentioned cases, it is also preferable that armatures which follow the needles moving between the first and second positions are attached to the other end portions of the needles, the driving means includes electromagnets to selectively draw the armatures to selectively move the needles from the first to the second position, and the armatures collide with the stoppers to stop the needles at the second position in the course of their moving from the first position, and that the stoppers be the cores of electromagnets. When so constructed, the merits achieved are as cited above.

It is also preferable in the above case that the driving force of the driving means be adjusted by the magnitude of the magnetic force generated by the electromagnets. This construction can make a drive force adjusting means which is simpler in construction and more reliable in performance, as said drive force adjusting means serves to adjust the drive force of the driving means.

DETAILED DESCRIPTION OF THE PREFERRED EMBODIMENTS

Figure 1:
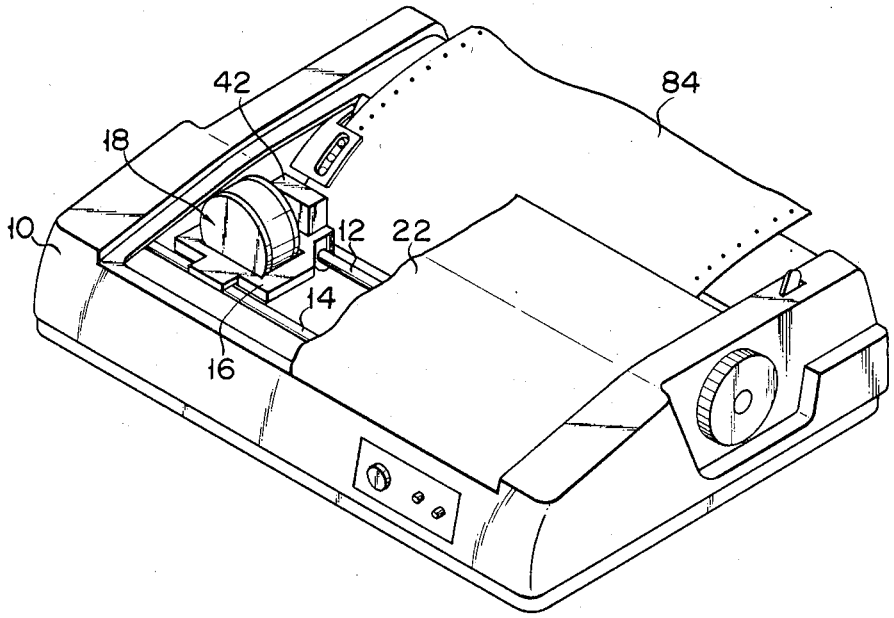
FIG. 1 is a perspective view partially and schematically showing the ink dot printer, of the first embodiment of the present invention.
Figure 2:
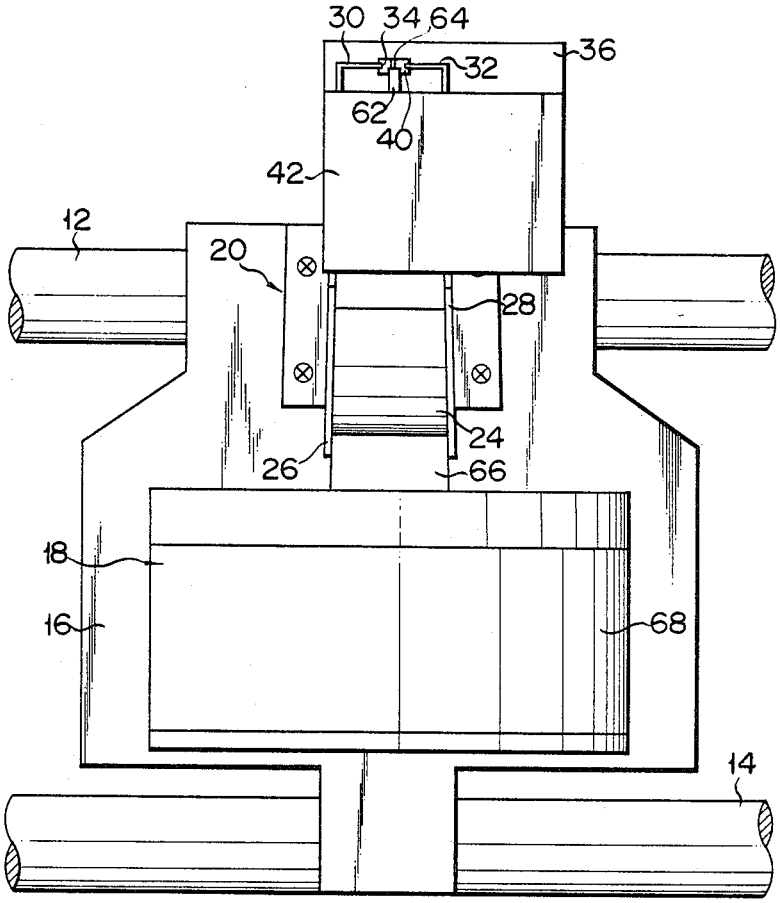
FIG. 2 is a plane view showing, in an enlarged scale, a printing head of the ink dot printer shown in FIG. 1 and its vicinity.

An ink dot printer of the first embodiment of the present invention is roughly shown in FIG. 1. A carriage 16 which can reciprocate along a carrier shaft 12 and a guide shaft 14 is arranged in the housing 10 of the ink dot printer. A printing head 18 and an ink film forming means 20 are mounted on the carriage 16, as shown in FIG. 2. The housing 10 has a cover 22 which covers the carrier shaft 12, guide shaft 14, carriage 16, printing head 18 and ink film forming means 20, as shown in FIG. 1. The cover 22 is partially cut off in FIG. 1 for the clarity of description.

Figure 3:
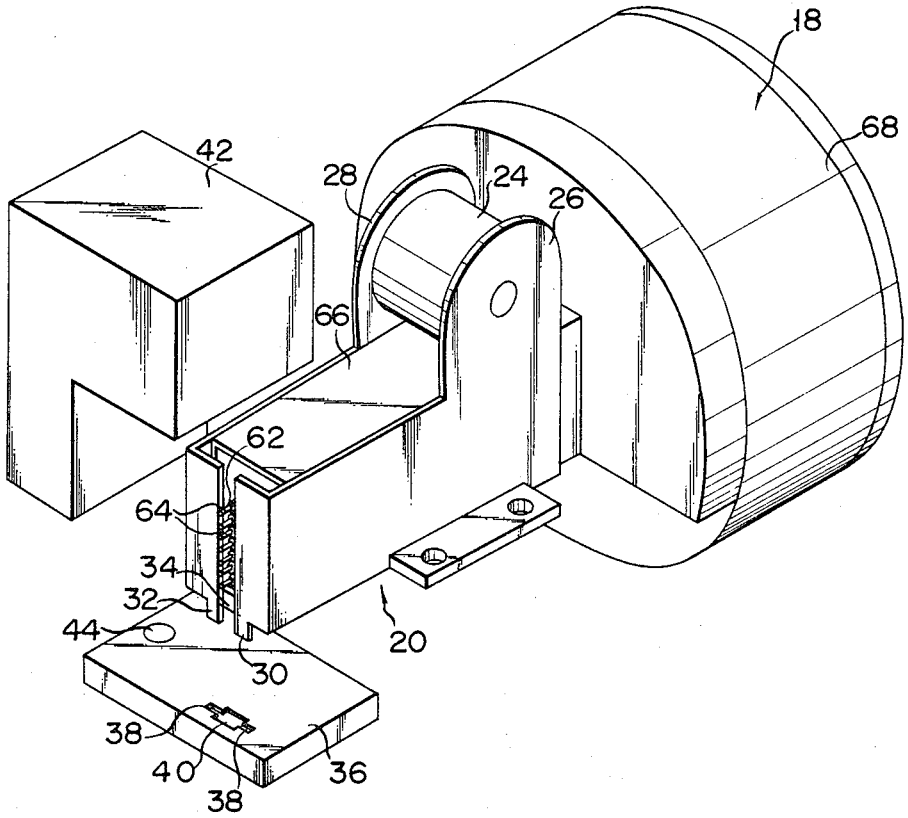
FIG. 3 is a perspective view showing the vicinity of the printing head of FIG. 2 when dismantled.

As shown in FIGS. 2 and 3, the ink film forming means 20 has an electromagnet 24 whose opposite ends are attached to a pair of magnetic pole plates 26 and 28. The front end portions 30 and 32 of the paired magnetic pole plates 26 and 28 are adapted to form a slit 34, under which is arranged an ink tank 36 which is freely detachable from the carriage 16.

As shown in detail particularly in FIG. 3, a slot 38 into which the lower ends of the front end portions 30 and 32 of the paired magnetic pole plates 26 and 28 are inserted is formed in the upper face of the ink tank 36, said slot 38 having in the center thereof a ventilation hole 40 which corresponds to the slit 34 of the paired magnetic pole plates 26 and 28. A hole 44 for connecting an ink cartridge 42 therewith is also formed in the upper face of the ink tank 36. A permanent magnet 46 is fixed on the outer surface of the bottom of the ink tank 36 to be opposite to the slit 34 of the paired magnetic pole plates 26 and 28, as shown in FIG. 4.

Figure 4:
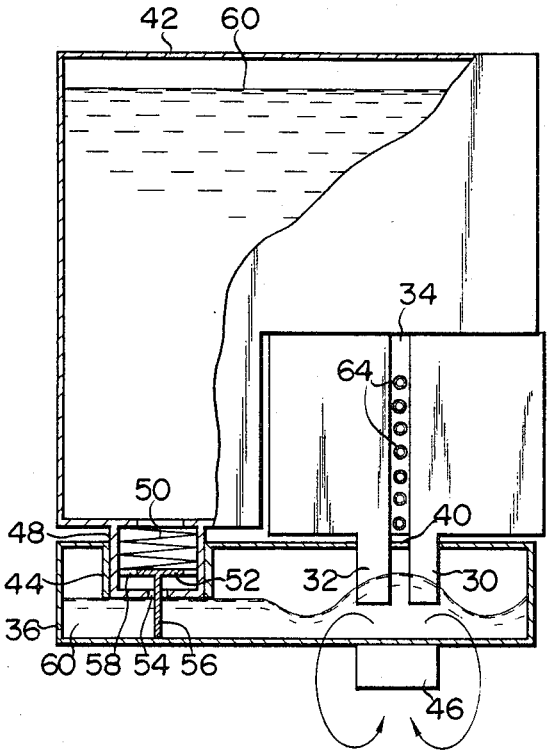
FIG. 4 is a front view showing the vicinity of the printing head of FIG. 2 when partially cut off.

As shown in FIG. 4, a sleeve 48, detachably fitted into the connecting hole 44 of the ink tank 36, is formed on the underside of the ink cartridge 42. A spring 50 and a plate-shaped plug 52 which is urged downward by the spring 50 are arranged in the sleeve 48. The plug 52 has a push rod 56 extending downward to project outside through a discharge opening 54 which is formed in the bottom of the sleeve 48. The plug 52 is also provided with plural cut-away portions of the outer circumference thereof. The radius of a circle which connects the inner ends of these cut-away portions is set to be larger than that of the discharge opening 54.

In the ink cartridge having the arrangement described above, the push rod 56 is brought into contact with the inner face of bottom of the ink tank 36 to separate the plug 52 from the discharge opening 54 against the action of the spring 50, as shown in FIG. 4, when the sleeve 48 is fitted into the connecting hole 44 of the ink tank 36. Accordingly, magnetic ink 60 in the ink cartridge 42 flows into the ink tank 36 through the cut-away portions of the plug 52 and the discharge opening 54 of the sleeve 48. The flow of magnetic ink 60 into the ink tank 36 stops when the level of magnetic ink 60 in the ink tank 36 reaches the discharge opening 54 of the sleeve 48 of the ink cartridge 42, and thereafter, the level of magnetic ink 60 in the ink tank 36 is kept equal to the level of the discharge opening 54 of the sleeve 48 of the ink cartridge 42 until no magnetic ink 60 is left in the ink cartridge 42. The front end portions 30 and 32 of the paired magnetic pole plates 26 and 28 which have been inserted into the slot 38 of the ink tank 36 are immersed in the magnetic ink 60 in the ink tank 36 at this time, as shown in FIG. 4.

Figure 5:
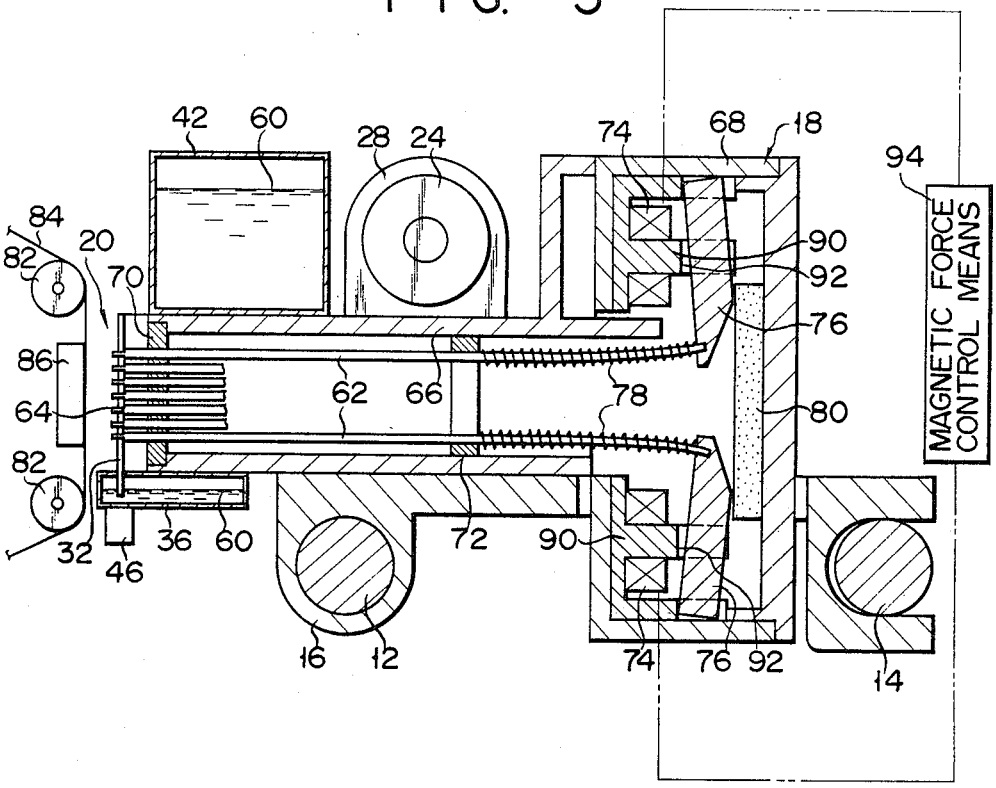
FIG. 5 is a longitudinally sectional view schematically showing the vicinity of the printing head of FIG. 2 in which needles are located at the first position.

As shown in FIGS. 2 and 4, one end portions 64 of the needles 62 which are arranged adjacent to one another along the longitudinal direction of the slit 34 can be found in the slit 34 of the paired magnetic pole plates 26 and 28. The other end portions of the same needles 62 extend through a frame 66 arranged between the paired magnetic pole plates 26 and 28, as shown in FIGS. 2 and 3, and into the cover 68 of the printing head 18, as shown in FIG. 5. The needles 62 are held in place by needle guides 70 and 72 which permit the needles to be freely movable in the longitudinal direction. The position of the needles 62 under this state is represented as the first position of the needles 62.

As shown in FIG. 5, electromagnets 74 which serve as a means for driving the needles 62 are arranged in the cover 68 of the printing head 18 to correspond to the plural needles 62. Armatures 76 connected to the other end portions of the needles 62 are arranged adjacent to the electromagnets 74. The needles 62 are urged together with the armatures 76 toward their first position shown in FIG. 5 by the action of return springs 78 each of which is fitted onto an individual needle 62. The armatures 76 are contacted with a contact member 80 under this state.

As shown in FIG. 5, a recording paper 84 which is fed by paper feed rollers 82 is arranged in front of the printing head 18 and ink film forming means 20 inside the housing 10 shown in FIG. 1. A platen 86 is also arranged at the back of the recording paper 84, corresponding to the needles 62. The platen 86 is made of a magnet in this embodiment.

Figure 6:
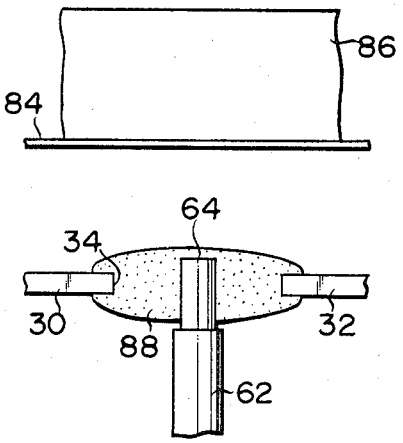
FIG. 6 is a plane view showing, in enlarged scale, the vicinity of a slit to show a magnetic ink film formed in the slit of an ink film forming means arranged adjacent to the printing head of FIG. 5.

In the case of this first embodiment of the present invention having the arrangement as described above, current is supplied to the electromagnet 24 when a main switch (not shown) on the housing 10 is turned ON. As a result, the magnetic ink 60 is drawn into the slit 34 between the front end portions 30 and 32 of the paired magnetic pole plates 26 and 28, thanks to magnetic flux generated between the front end portions 30 and 32 of the paired magnetic pole plates 26 and 28, as shown in FIG. 6. The one end portions 64 of the needles 62 which are located at the first position are immersed in the magnetic ink film 88 in the slit 34.

Figure 7:
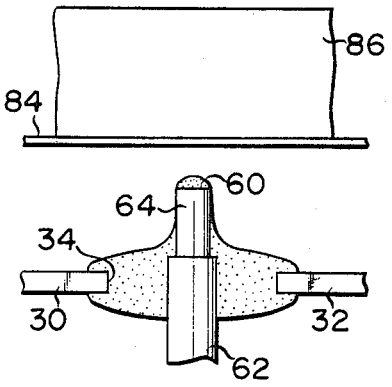
FIG. 7 is a plane view showing the needles of FIG. 6 located at the second position.
Figure 8:
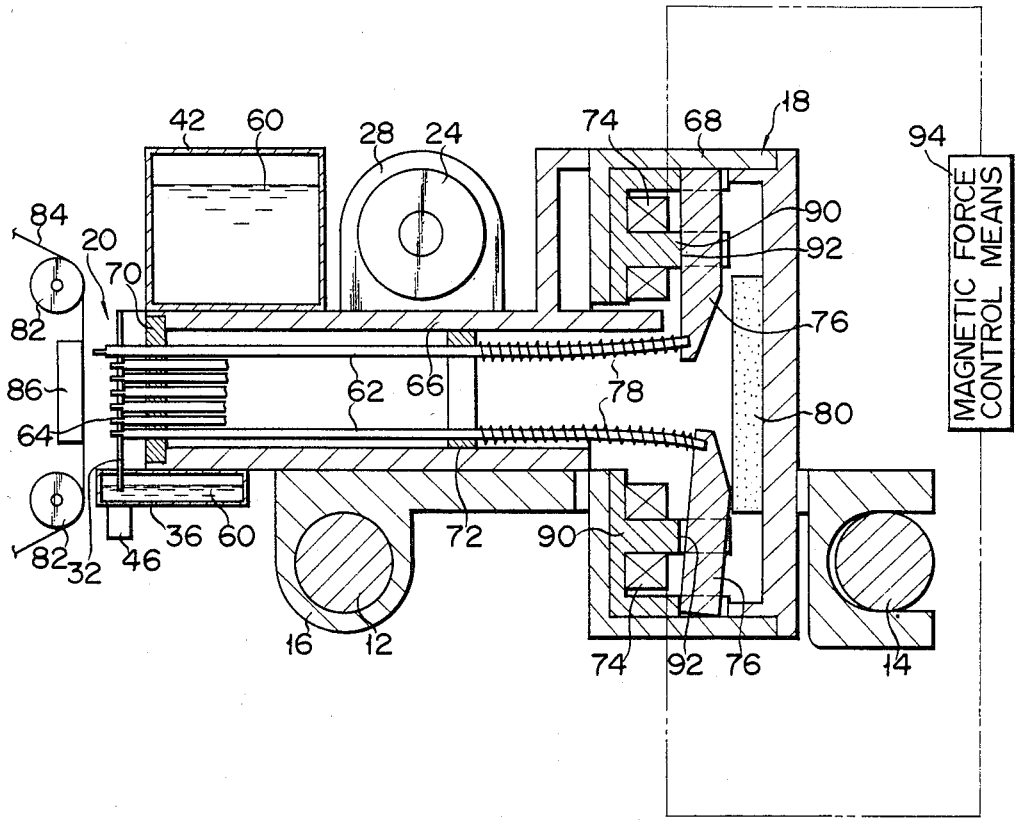
FIG. 8 is a longitudinally sectional view, similar to FIG. 5, showing a needle of FIG. 5 located at the second position.

When a key on a keyboard (not shown) is then pushed, current is supplied to the electromagnet 74 which corresponds to the key. The armature 76 which corresponds to this electromagnet 74 is drawn against the urging force of the return spring 78 fitted onto the needle 62. The needle 62 which corresponds to the armature 76 drawn by the electromagnet 74 projects from the magnetic ink film 88 in the slit 34 toward the recording paper 84 on the platen 86, as shown in FIG. 7 and only stops its movement toward the recording paper 86 when the armature 76 collides with the drawing face 92 of the core 90 of the electromagnet 74, as shown in FIG. 8. The end face of the one end portion 64 of the needle 62 is separated from the recording paper 84 on the platen 86 by a distance greater than the thickness of the magnetic ink 60 on this end face, as shown in FIG. 7. The position of the needle 62 under this state is denoted as a second position of the needle 62. In this embodiment, the core 90 of the electromagnet 74 serves as a stopper for holding the needle 62 at the second position, as is apparent from the above.

Figure 9:
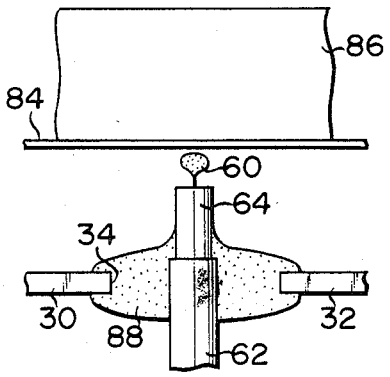
FIG. 9 is a plane view showing how the magnetic ink flies from the end face of one end portion of each needle of FIG. 6 onto a recording paper on a platen.
Figure 10:
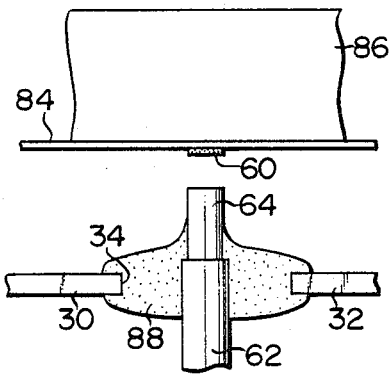
FIG. 10 is a plane view showing the magnetic ink, which has flown from the end face of one end portion of the needle of FIG. 6 onto the recording paper on a platen.

The magnetic ink 60 on the end face of the one end portion 64 of the needle 62 which has been located at the second position is drawn by the magnetic force of the platen 86, to fly toward the recording paper 84 on the platen 86, as shown in FIG. 9 and to adhere thereon, as shown in FIG. 10, thereby forming a dot of magnetic ink 60.

In this embodiment, the inertia of the magnetic ink 60 on the end face of the one end portion 64 of the needle 62, which is caused when the needle 62 moves from the first position shown in FIGS. 5 and 6, and is stopped at the second position shown in FIGS. 7 and 8 by the collision of the armature 76 against the drawing face 92 of the core 90 which serves as a stopper, assists in flying the magnetic ink 60 from the end face of the one end portion 64 of the needle 62 located at the second position onto the recording paper 84 on the platen 86.

When the main switch (not shown) is turned OFF after the printing process has finished the supply of current to the electromagnet 24 is stopped. As a result, the magnetic flux formed between the paired magnetic pole plates 26 and 28 vanishes. This permits the magnetic ink 60 which has formed the film 88 in the slit 34 to be collected through the force of gravity in the ink tank 36 through the ventilation hole 40. The magnetic force generated by the permanent magnet 46 on the underside of the ink tank 36 draws the magnetic ink 60 from the slit 34 into the ink tank 36 at this time, thereby preventing the magnetic ink 60 from being left in the slit 34 because of surface tension.

A second embodiment of the present invention will be described referring to FIGS. 11 and 12. The same parts as those in the first embodiment will be denoted by the same reference numerals, and a detailed description of these parts will be omitted.

Figure 11:
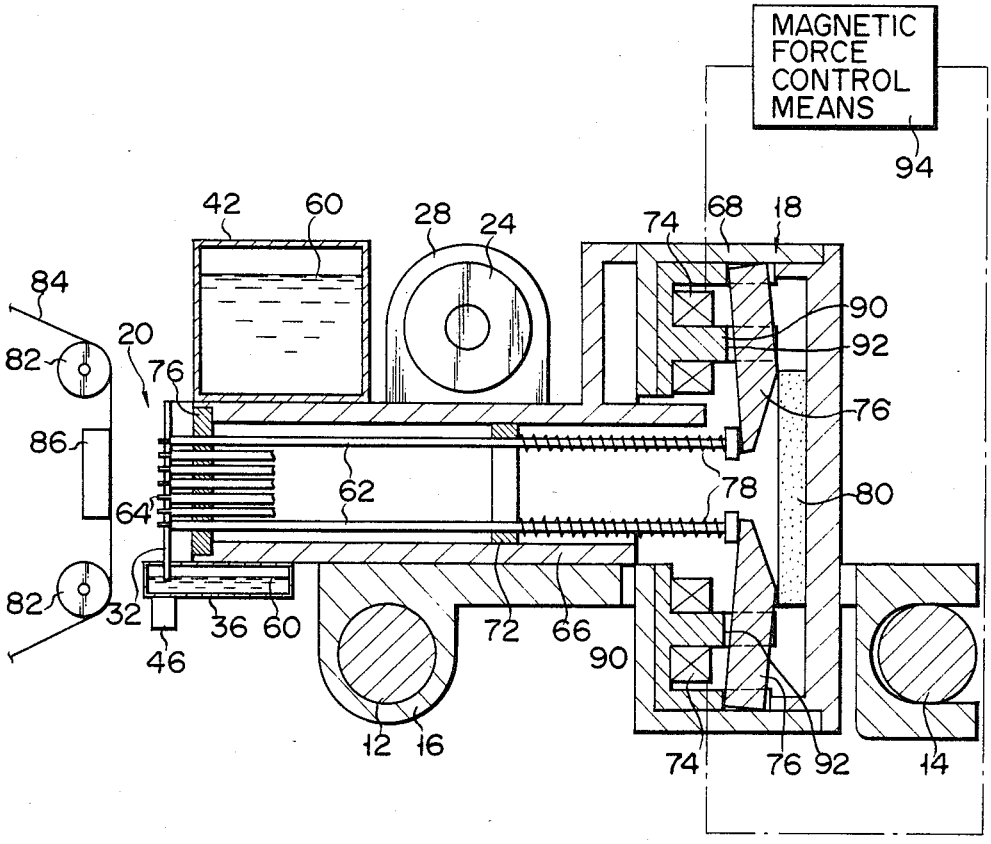
FIG. 11 is a longitudinally sectional view, similar to FIG. 5, showing the vicinity of the printing head of an ink dot printer which has been embodied as a second embodiment of the present invention, in which the needles are located at the first position.

As shown in FIG. 11, the other end portions of the needles 62 are not attached to the armature 76. Considering the inertia of the armature 76 and the urging force of the return spring 78, the mass of each of the needles 62 is set to have a predetermined value that stops each needle 62 at the second position shown in FIG. 12, in the course of moving from the first position shown in FIG. 11, without applying any external force such as the one caused by the collision against the stopper, for example. The second position shown in FIG. 12 is similar to that in the first embodiment which has been described referring to FIGS. 7 and 8, and the end face of the one end portion 64 of the needle 62 which has been located at the second position is separated from the recording paper 84 on the platen 86 by a distance greater than the thickness of the magnetic ink on the needle.

Figure 12:
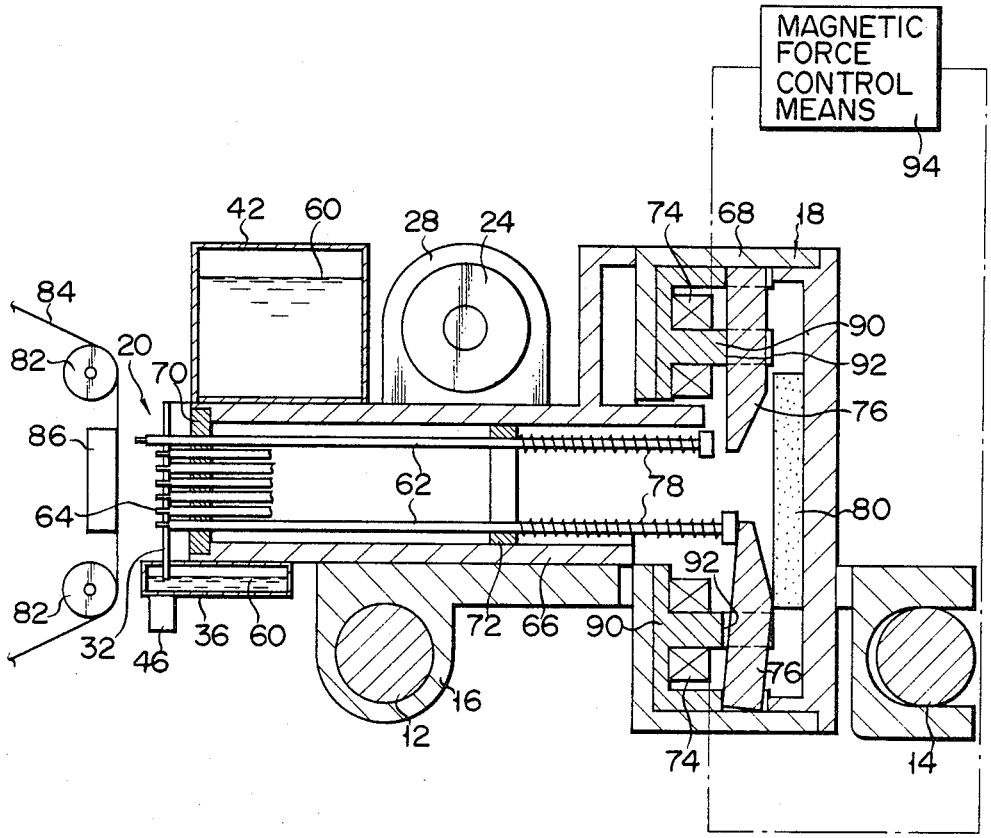
FIG. 12 is a longitudinally sectional view, similar to FIG. 11, showing one of the needles located at the second position.

Similar to the case of the first embodiment, the magnetic ink on the end face of the one end portion 64 of the needle 62 which has been located at the second position shown in FIG. 12 is drawn by the magnetic force generated by the platen which is a magnet, to fly onto the recording paper 84 on the platen 86, as shown in FIG. 9, and adhere thereto, as shown in FIG. 10, thereby forming a dot of magnetic ink 60.

It should be understood that the present invention is not limited to the above-described embodiments, but that various kinds of changes and modifications can be made without departing from the spirit and scope of the present invention.

In the case of the first embodiment, for example, the platen 86 is not made of a magnet or magnetized material, but the magnetude of the magnetic force generated by the electromagnets 74 which serve as a means for driving the needles may be adjusted in such a way that the magnetic ink 60 is caused to fly from the end face of the one end portion 64 of the needle 62 onto the recording paper 84 only due to the inertia of the magnetic ink on the end face of the one end portion 64 of the needle 62 which is caused by the collision of the armature 76 against the drawing face 92 of the core 90 which serves as a stopper. More specifically, the magnetude of the magnetic force generated by the electromagnets 74 can be adjusted in such a way that a magnetic force control means 94 whose construction is well known in connected to the electromagnets 74, as shown in FIGS. 5 and 6, and that current or voltage supplied to the electromagnets 74 is adjusted by this means.

In the case of the second embodiment shown in FIGS. 11 and 12, also, the magnetude of the magnetic force generated by the electromagnets 74 can be adjusted by connecting the well known magnetic force control means 94 to the electromagnets 74.

What is claimed is:

1. An ink dot printer comprising:

a means for storing magnetic ink;

a pair of magnetic pole plates arranged opposite to each other to form a slit whose one end is immersed in the magnetic ink supplied from the magnetic ink storing;

a magnetism generating means for magnetizing the paired magnetic pole plates to introduce the magnetic ink supplied from the magnetic ink storing means into the slit to form a magnetic ink film therein;

a plurality of needles arranged adjacent to one another along the longitudinal direction of the slit which each is freely movable in its longitudinal direction between a first position where its one end portion is immersed in the magnetic ink film in the slit formed by the paired magnetic pole plates and a second position where its one end portion is projected from the magnetic ink film in the slit;

a driving means for selectively driving the needles to move from the first position to the second position;

a space forming means for separating the end faces of the one end portions of the needles, which have been located at the second position, from a recording paper on a platen by a distance greater than the thickness of the magnetic ink on each of the end faces; and a magnetic ink flying means for flying the magnetic ink from the end faces of the one end portions of the needles, which have been located at the second position, onto the recording paper on the platen to force the magnetic ink on the recording paper on the platen to form dots of magnetic ink thereon;

wherein symbols such as characters or numerals can be printed on the recording paper by the groupings of dots of the magnetic ink.

2. An ink dot printer according to claim 1, wherein said magnetic ink flying means has a magnet located on the side of the platen which is opposite to the end faces of the one end portions of the needles.

3. An ink dot printer according to claim 2, wherein said magnet is a magnetized platen.

4. An ink dot printer according to claim 2, wherein the space forming means includes stoppers which collide with the needles in the course of their moving from the first position to stop them at the second position.

5. An ink dot printer according to claim 4, wherein said magnet is a magnetized platen.

6. An ink dot printer according to claim 4, wherein armatures which follow the needles moving between the first and second positions are attached to the other end portions of the needles, the driving means includes electromagnets to selectively draw the armatures to selectively move the needles from the first to the second position, and the armatures collide with the stoppers to stop the needles at the second position in the course of their moving from the first position.

7. An ink dot printer according to claim 6, wherein said magnet is a magnetized platen.

8. An ink dot printer according to claim 6, wherein said stoppers are cores of the electromagnets.

9. An ink dot printer according to claim 8, wherein said magnet is a magnetized platen.

10. An ink dot printer according to claim 2, wherein said space forming means is constructed by setting the mass of each of the needles to have a predetermined value which corresponds to the driving force of the driving means and which enables the needle to be stopped at the second position without applying any external force to it in the course of its moving from the first position.

11. An ink dot printer according to claim 10, wherein said magnet is a magnetized platen.

12. An ink dot printer according to claim 10, wherein armatures movable in the movement direction of the needles are disposed depending on the positions of the other ends of the respective needles, and the driving means includes an electromagnets to selectively draw the armatures to selectively move the needles from the first to the second position, the magnitude of the driving force of the driving means being adjusted by the magnitude of the magnetic force generated by the electromagnets.

13. An ink dot printer according to claim 1, wherein said spaced forming means includes stoppers which collide with the needles in the course of their moving from the first position to stop the needles at the second position, and the magnetic ink flying means is adapted to set the driving force of the driving means in such a way that the magnetic in flies from the end faces of the one end portions of the needles onto the recording paper thanks to an inertia of the magnetic ink on the end faces of the one end portions of the needles which is caused by the collision of the needles with the stoppers.

14. An ink dot printer according to claim 13, wherein armatures which follow the needles moving between the first and second positions are attached to the other end portions of the needles, the driving means includes electromagnets to selectively draw the armatures to selectively move the needles from the first to the second position, and the armatures collide with the stoppers to stop the needles at the second position in the course of their moving from the first position.

15. An ink dot printer according to claim 14, wherein said stoppers are cores of the electromagnets.

16. An ink dot printer according to claim 14, wherein the magnitude of the driving force of the driving means is adjusted by that of the magnitude of the magnetic force generated by the electromagnets.

17. An ink dot printer according to claim 16, wherein said stoppers are cores of the electromagnets.

* * * * *

UNITED STATES PATENT AND TRADEMARK OFFICE

CERTIFICATE OF CORRECTION

PATENT NO. : 4,552,469

DATED : November 12, 1985

INVENTOR(S) : Takeyoshi TSUGE et al

It is certified that error appears in the above-identified patent and that said Letters Patent is hereby corrected as shown below:

COLUMN 7 (Claim 1), line 53, change "storing" to --storing means--.

Signed and Sealed this

*Twenty-fourth* Day of *June 1986*

[SEAL]

*Attest:*

DONALD J. QUIGG

*Attesting Officer*

*Commissioner of Patents and Trademarks*